US006308034B1

(12) United States Patent
Nakashima et al.

(10) Patent No.: US 6,308,034 B1
(45) Date of Patent: Oct. 23, 2001

(54) WET-TYPE ELECTROPHOTOGRAPHY APPARATUS, USING NON-VOLATILE, HIGH VISCOSITY, HIGH CONCENTRATION LIQUID TONER

(75) Inventors: Yutaka Nakashima, Kanazawa; Akihiko Inamoto, Uchinada-machi; Shigeki Uesugi, Unoke-machi; Satoru Moto, Kanazawa; Motoharu Ichida, Tsubata-machi; Masanari Takabatake, Kanazawa; Shigeharu Okano, Hakui; Seiichi Takeda, Kanazawa, all of (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 09/403,898

(22) PCT Filed: Mar. 25, 1999

(86) PCT No.: PCT/JP99/01521

§ 371 Date: May 1, 2000

§ 102(e) Date: May 1, 2000

(87) PCT Pub. No.: WO99/50716

PCT Pub. Date: Oct. 7, 1999

(30) Foreign Application Priority Data

| | | |
|---|---|---|
| Mar. 25, 1998 | (JP) | 10-076370 |
| Aug. 3, 1998 | (JP) | 10-218407 |
| Aug. 5, 1998 | (JP) | 10-221181 |
| Feb. 4, 1999 | (JP) | 11-026960 |

(51) Int. Cl.[7] ..... G03G 15/10
(52) U.S. Cl. ..... 399/249; 399/348
(58) Field of Search ..... 399/249, 233, 399/222, 237, 343, 348, 358, 359, 360

(56) References Cited

U.S. PATENT DOCUMENTS

| | | | | |
|---|---|---|---|---|
| 5,640,655 | * | 6/1997 | Shoji et al. | 399/249 |
| 5,689,780 | * | 11/1997 | Tamura et al. | 399/249 |
| 6,072,972 | * | 6/2000 | Obu et al. | 399/237 |
| 6,137,976 | * | 10/2000 | Itaya et al. | 399/233 |
| 6,167,225 | * | 12/2000 | Sasaki et al. | 399/237 |

FOREIGN PATENT DOCUMENTS

| | | |
|---|---|---|
| 53-124427 | 10/1978 | (JP) . |
| 3-43749 | 2/1991 | (JP) . |
| 3-168783 | 7/1991 | (JP) . |
| 4-1770 | 1/1992 | (JP) . |
| 7-239615 | 9/1995 | (JP) . |
| 8-137277 | 5/1996 | (JP) . |
| 8-152788 | 6/1996 | (JP) . |
| 10-171256 | 6/1998 | (JP) . |
| 10-293471 | 11/1998 | (JP) . |

* cited by examiner

*Primary Examiner*—Sophia S. Chen
*Assistant Examiner*—Hoan Tran

(57) ABSTRACT

A wet-type electrophotography apparatus using a non-volatile, high-viscosity, high-concentration liquid toner as a liquid developer and having a photoconductive medium, a prewetting device applying a film of prewetting solution to the surface of the photoconductive medium, a developing roller feeding the liquid developer to the photoconductive medium while making contact with the photoconductive medium, and causing toner particles in the liquid developer to adhere to the photoconductive medium in accordance with a electric field formed between the developing roller and the photoconductive medium, so that a toner image formed on the photoconductive medium is transferred directly to a printing medium, or to a printing media via an intermediate transfer medium to obtain a printed image. The apparatus also has oil removal means making contact with the formed toner image surface to remove the excess prewetting solution and the excess carrier solution in the liquid toner from the toner image surface on either the photoconductive medium or the intermediate transfer medium.

18 Claims, 12 Drawing Sheets

(a)

(b)

WET-TYPE ELECTROPHOTOGRAPHY APPARATUS, USING NON-VOLATILE, HIGH VISCOSITY, HIGH CONCENTRATION LIQUID TONER

FIELD OF THE INVENTION

The present invention relates generally to a wet-type electrophotography apparatus using a non-volatile, high-viscosity, high-concentration liquid toner, and more particularly to a wet-type electrophotography apparatus capable of removing excess prewetting solution and excess carrier solution in the developing toner layer before they are transferred from a photoconductive medium or from an intermediate transfer medium, or controlling the amount of the toner replenished to the developer.

BACKGROUND ART

As for electrophotography apparatus in which an electrostatic latent image is formed on a photoconductive medium (photoconductive drum); a toner is deposited on the charged image; and then transferred and thermally fixed onto a printing medium, such as paper, the dry type using a powder toner has been widely employed.

The powder toner, however, tends to be scattered and often involves the problem of poor resolution due to its particles sizes as large as 7~10 μm.

In applications requiring high resolution, therefore, the wet-type using a liquid toner is usually adopted. The liquid toner is less subject to distortion in toner images and can achieve high resolution because it contains toner particles as small as 1 μm and has a large charging capacity.

In the conventional wet-type electrophotography apparatus, a low-viscosity liquid toner obtained by mixing 1~2% of toner in an organic solvent has been commonly used as the developing solution. This type of developing solution, however, causes environmental concerns because it contains an organic solvent harmful to the human body and requires a large amount of consumption due to low concentration.

With the conventional wet-type electrophotography apparatus, a solvent that is highly volatile at normal temperatures has been used as the carrier solution, and the excess carrier has been caused to evaporate in the air during the heating and fusing of the toner. That is, the problem of residual carrier solution has been solved without using any special carrier removal equipment. Due to the toxicity and flammability of the solvent used, however, the evaporated carrier has had to be recovered with a large carrier recovery equipment in which it is liquefied for recovery, and the air containing the unrecovered solvent has had to be discharged outdoors with a dedicated ventilation duct. All this has resulted in high cost due to limitations in the site of installation and the large size of equipment.

It was against this background that a wet-type electrophotography apparatus using a high-viscosity, high-concentration developing solution obtained by dispersing a high-concentration toner in silicone oil, etc. was disclosed in International Disclosure Number "WO95/08792." The use of a liquid toner eliminates not only harm to the human body but also the need for large consumption of developing solution due to high toner concentration.

The use of a non-volatile, high-viscosity and high-concentration liquid toner involves prewetting treatment where silicone oil or other prewetting solution is applied to the photoconductive medium prior to the application of the liquid toner so as to prevent the high-viscosity toner from being deposited on the unexposed area of an electrostatic latent image formed on the photoconductive medium. The prewetting solution layer applied during prewetting treatment helps prevent the toner from being deposited on the unexposed area on the photoconductive medium, as shown in FIG. 3. The prewetting solution is an insulating solution having the same or lower viscosity than that of the carrier solution of the developer, and should be applied to a film thickness of not less than 4 μm, or more preferably 8 μm~20 μm, to prevent the toner layer on the developing roller from coming direct contact with the photoconductive medium.

According to International Disclosure Number "WO95/08792," the oil used as a prewetting solution should have a viscosity of 0.5~5.0 mPa·S and should be a volatile oil in terms of practical use because a delayed volatilization of the oil remaining on the paper may cause some inconveniences. In other words, it can be said that the process is based on the assumption that the prewetting agent is volatilized to the atmosphere by the heat applied during the fusing process.

This type of process basically involving positive volatilization, however, inevitably limits the service environment of equipment, or has to have equipment of a hermetically enclosed construction and a device for recovering volatile matter and liquefying it by cooling, despite the fact that silicone oil itself is a substance that is harmless to human beings and environment.

The prewetting agent, which is needed for the development process, becomes unnecessary after development. The developing roller comes in contact with the photoconductive medium during development and deposits the toner on the image area by applying a voltage on the roller. After development, the toner image on the photoconductive medium is transferred onto the intermediate transfer medium by the force of electric field. At this time, the prewetting solution and the carrier solution are transferred onto the intermediate transfer medium, together with the developing toner, exerting an influence on the fusion of the toner layer during the fusion process. The toner particles suspending in the prewetting solution are deposited on the background area as a fogged area (depositing of unwanted toner). In this way, the prewetting agent of a predetermined thickness is needed at the time of development using a developing roller, but becomes unnecessary after development. The excess prewetting solution after development reaches an area where the photoconductive medium and the intermediate transfer medium come in contact with each other, and remains there to disturb the image. Furthermore, as the excess prewetting solution is transferred to the intermediate transfer medium, it exerts an influence on the fusion of the toner layer during fixing. The excess prewetting agent should therefore be removed.

Similarly, a predetermined amount of carrier solution in the developing solution is needed to ensure that the developing solution can be supplied to the developing roller in a uniform thickness, and that the toner can be deposited from the developing roller on the image area on the photoconductive medium, but it becomes unnecessary after development. The liquid toner in the liquid developing system can be divided into the solids content and the liquid content. The solids content comprises a thermoplastic resin and pigments, while the liquid content, called the carrier, or carrier solution, includes additives that determine the developing performance and shell stability. The carrier has an important role of transporting fine particles (solids content) of a size about 1/10 of the dry-type development with good dispersion performance throughout the process ranging from development through transfer. The carrier that has outlived its usefulness and remains unremoved up to the next fusion and transfer process could induce imperfect transfer or insufficient fixing. The excess carrier must therefore be removed in some way or other prior to fusion and transfer. Furthermore, the toner particles suspending in the prewetting solution must be removed since they could cause fogging.

Imparting recyclability to this type of non-volatile, high-viscosity and high-concentration liquid toner would lead to greater convenience. In general, the dry-type electrophotography apparatus using powder toner is not based on the use of recyclable powder toner because powder toner can hardly be diluted. In the dry-type electrophotography apparatus, the toner is supplied to the photoconductive medium by supplying the powder toner to the developing roller which is charged by friction with a blade, and the powder toner is replenished to the portion of the developing roller which is transferred to the photoconductive medium.

With the wet-type electrophotography apparatus using liquid toner, on the other hand, the recycling of liquid toner is commonly practiced because the liquid toner can be diluted.

In the wet-type electrophotography apparatus using a low-viscosity liquid toner obtained by mixing 1~2% of toner with organic solvent, the concept of recycling organic solvent can be applied, but the concept of recycling liquid toner itself does not hold. Judging from the fact that the liquid toner is fed to the apparatus by spraying it in a large amount to the photoconductive medium due to low toner concentration, the liquid toner itself cannot be recovered. Consequently, even the International Disclosure Number "WO95/08792" does not adopt the concept of recycling liquid toner, following the prior art.

In the case of a high-viscosity, high-concentration liquid toner obtained by dispersing high-concentration toner in silicone oil, etc. however, the concept of recycling can be introduced, unlike other types of liquid toner, since it has entirely different properties from those of liquid toners used in conventional wet-type electrophotography apparatuses. In this case, it is necessary to implement recycling method by taking advantage of the characteristics of the liquid toner such as high viscosity and high concentration.

DISCLOSURE OF THE INVENTION

The present invention has been conceived taking into account the aforementioned circumstances, and it is therefore an object of the present invention to provide a new wet-type electrophotography apparatus using a non-volatile, high-viscosity and high-concentration liquid toner wherein excess prewetting solution and toner particles suspending in the prewetting solution are removed after development, and excess carrier solution in the developing toner layer is also removed.

It is another object of this invention to make it possible to apply the present invention not only to a wet-type electrophotography apparatus using a non-volatile, high-viscosity and high-concentration liquid toner but also to a liquid-developer type electrophotography apparatus using a volatile solvent to increase solvent removal rate.

It is a further object of the present invention to make it possible to use a non-volatile oil as a prewetting oil in a wet-type electrophotography apparatus using a non-volatile, high-viscosity and high-concentration liquid toner, and to use the same oil as the carrier oil of the liquid toner as the prewetting solution.

It is still a further object of the present invention to provide a new wet-type electrophotography apparatus where the heat applied to the intermediate transfer medium does not affect the photoconductive medium, thereby preventing photosensitive properties from deteriorating.

It is still a further object of the present invention to make it possible to easily recycle recovered toner merely by adjusting the concentration of the toner solids content, eliminating the need for separating the prewetting oil from the recovered liquid toner.

It is still a further object of the present invention to provide a new wet-type electrophotography apparatus using a non-volatile, high-viscosity and high-concentration liquid toner and having a liquid toner recycling function.

In accordance with the present invention, there is provided a wet-type electrophotography apparatus using a non-volatile, high-viscosity and high-concentration liquid toner as a liquid developing solution and comprising a photoconductive medium 10 for forming an electrostatic latent image, a prewetting device 13 for applying a prewetting solution film on the surface of the photoconductive medium 10, and a developing roller 26 for supplying the liquid developing solution while making contact with the photoconductive medium 10 and causing toner particles of the liquid developing solution to deposit onto the photoconductive medium 10 so as to obtain an image by transferring a toner image formed on the photoconductive medium 10 directly onto a printing medium or onto a printing medium via an intermediate transfer medium 15; the wet-type electrophotography apparatus having an oil removal mechanism 30 or 20 that comes in contact with the surface of the formed toner image to remove the oil comprising the excess prewetting solution and the excess liquid toner carrier solution from the formed toner image. The present invention can remove the excess prewetting solution and the excess carrier solution in the developing toner layer, and therefore the excess prewetting and carrier solutions are not caused to be brought to the contact portion between the photoconductive medium and the intermediate transfer medium, to build up there and flow to the surfaces of the media. As a result, the image can be prevented from being disturbed. The excess prewetting or carrier solution can be prevented from adversely affecting the heating and fusion of the toner layer during fixing. By removing the excess prewetting solution, the toner particles suspending therein that may cause fogging can also be removed.

The present invention can implement a carrier removal method where excess carrier can be directly recovered in a liquid-developer type electrophotography apparatus. As a result, a liquid-developer type electrophotography apparatus using a non-volatile solvent or solution that eliminates the need for a big carrier recovery device for liquefying the evaporated carrier for recovery or an outdoor exhauster can be realized. Solvent removal rate can be increased even in a liquid-developer type electrophotography apparatus using not only a non-volatile, high-viscosity and high-concentration liquid toner but also a volatile liquid.

Furthermore, the present invention can safely recover prewetting solution without the need for limiting the service environment of the equipment, or a mechanism of a hermetically sealed construction for collecting, cooling and liquefying volatile components for recovery by using a non-volatile solution as the prewetting solution in a wet-type electrophotography apparatus using a non-volatile, high-viscosity and high-concentration liquid toner as the liquid developer.

The present invention where the same type of insulating liquid as the liquid toner carrier solution is used as the prewetting solution can easily recycle the liquid toner merely by adjusting the concentration of the toner solid component eliminating the need for separating a prewetting oil from the liquid toner.

The present invention using an intermediate transfer belt as the intermediate transfer medium and a cooling means for cooling the toner image after fusion and transfer at a location immediately before bringing the intermediate transfer belt into contact with the photoconductive medium makes it possible to prevent the heating of the intermediate transfer medium (belt) from affecting the photoconductive medium, thereby preventing the photosensitive properties of the photoconductive medium from deteriorating.

The present invention can achieve results of high image density and good printing quality by using a high-viscosity prewetting solution.

The present invention can provide a new wet-type electrophotography apparatus having a liquid toner recycling function when the apparatus uses a non-volatile, high-viscosity and high-concentration liquid toner by providing a recovery means for recovering the liquid developing solution remaining on the surface of the developing roller as a liquid toner of a diluted concentration, and a recycling means for recycling the recovered liquid toner of a diluted concentration into a liquid toner having a predetermined concentration by mixing the recovered liquid toner of a diluted concentration with a high-concentration liquid toner having toner particles dispersed at a concentration higher than the predetermined concentration.

The present invention can know the consumption of toner particles and determine the amount of replenishment of toner particles without directly detecting the toner concentration by providing means for calculating printing duty based on printing data, and calculating the consumption of liquid toner based on the calculated printing duty and development efficiency. With this arrangement, the present invention can provide stable images without causing changes in the toner concentration in the toner reservoir at every printing operation.

BEST MODE FOR CARRYING OUT THE INVENTION

In the following, the present invention will be described in more detail in accordance with the best mode of operation. The present invention uses a non-volatile, high-viscosity and high-concentration liquid toner as the liquid developing solution. The liquid toner used is a solution obtained by dispersing toner particles, such as pigments, in a liquid carrier (oil).

Figure 1:
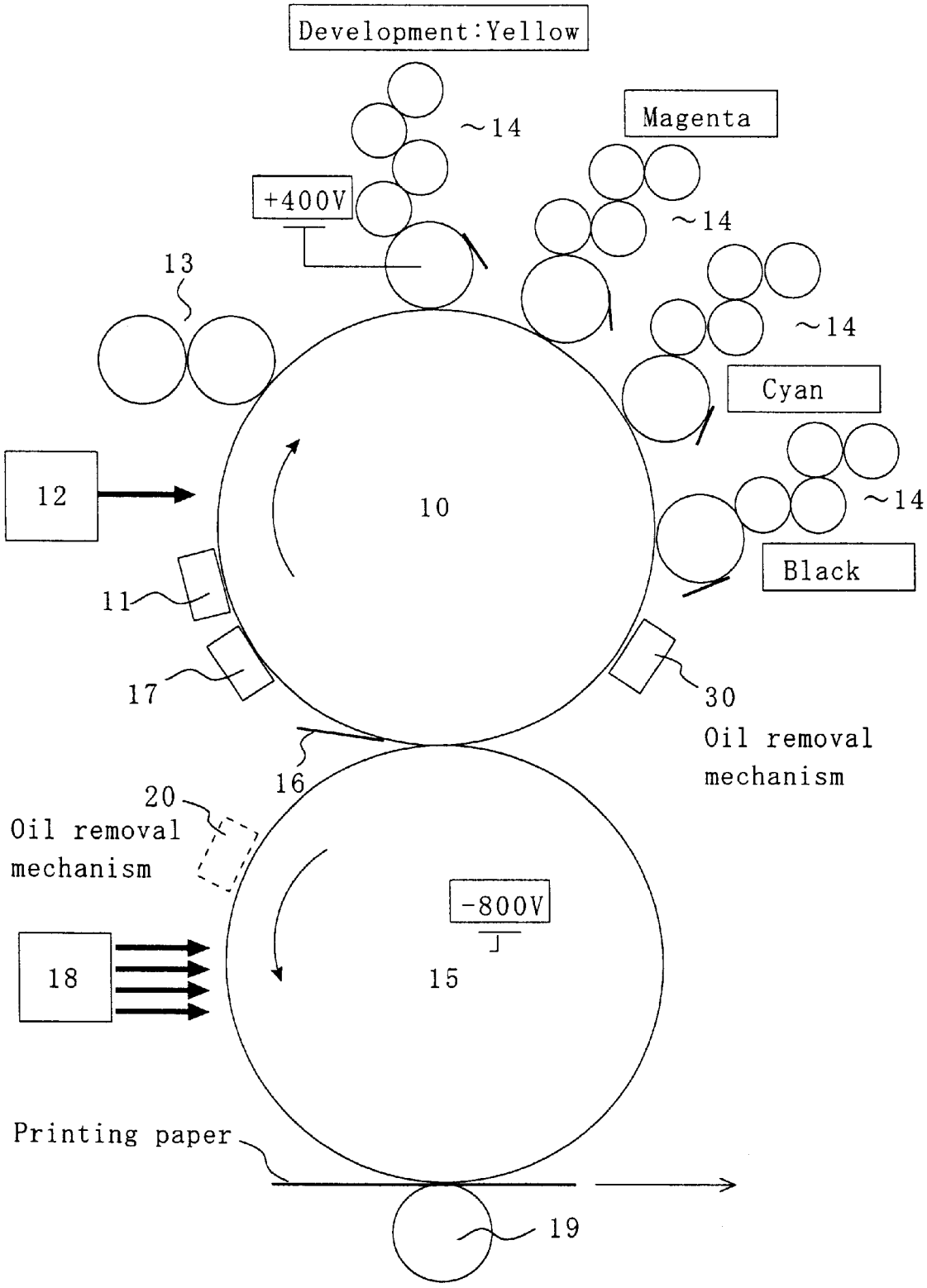
FIG. 1 is a general view of a wet-type electrophotography apparatus embodying the present invention.

FIG. 1 shows the general construction of a wet-type electrophotography apparatus embodying the present invention.

As shown in the figure, the wet-type electrophotography apparatus of the present invention comprises a photoconductive medium 10, a static charging device 11, an exposure device 12, a prewetting device 13, developing devices 14, an intermediate transfer medium 15, a blade 16, a static eliminator 17, a heating device 18, a pressure roller 19, and an oil removal mechanism 30 for removing oil on the photoconductive medium 10 (or an oil removal mechanism 20 for removing oil on the intermediate transfer medium 15).

The static charging device 11 statically charges the photoconductive medium 10 to about 700V. The exposure device 12 exposes the photoconductive medium 10 to a laser light having a wavelength of 780 nm to form on the photoconductive medium 10 a static latent image having a potential of about 100 V on the exposed area.

The prewetting device 13 applies a 4~10-$\mu$m thickness of silicone oil having a viscosity of about 10~500 cSt to the surface of the photoconductive medium 10. The prewetting device 13 used here may perform prewetting treatment prior to the exposure treatment carried out by the exposure device 12 in some cases, or after exposure treatment in other cases.

Figure 3:
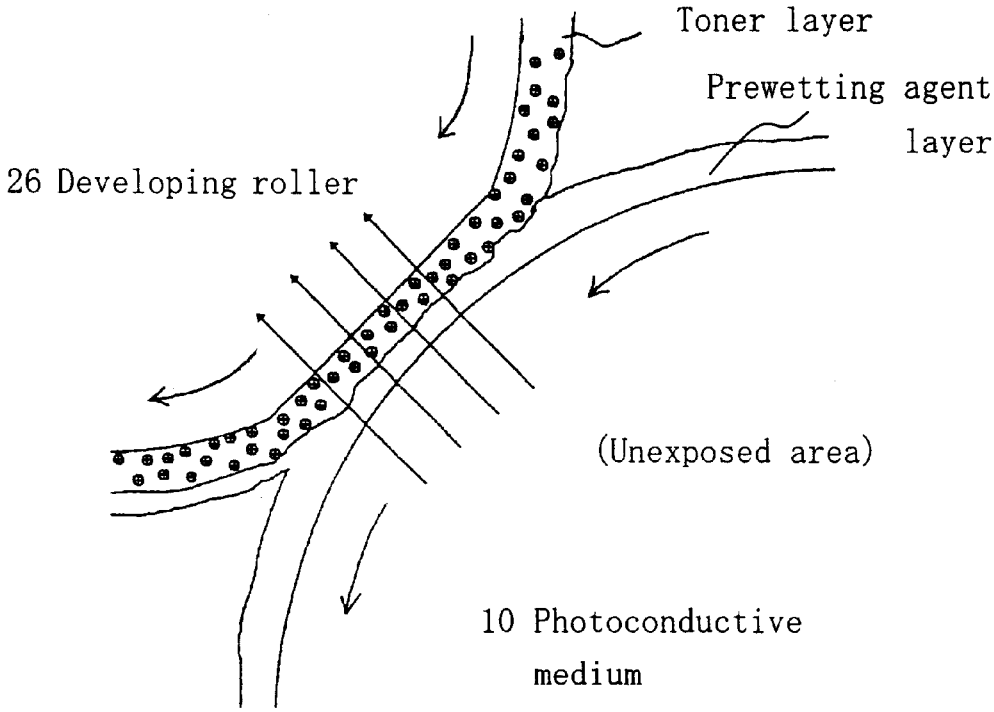
FIG. 3 is a diagram of assistance in explaining the operation of the prewetting layer applied during prewetting treatment.

In accordance with the prewetting agent layer applied in the prewetting treatment, the toner can be prevented from being deposited on the unexposed area of the photoconductive medium, as shown in FIG. 3. In an embodiment of the present invention, this prewetting solution is an insulating solution of the same type as the liquid toner carrier solution, and has a viscosity equal to, or lower than, that of the carrier solution.

Figure 2:
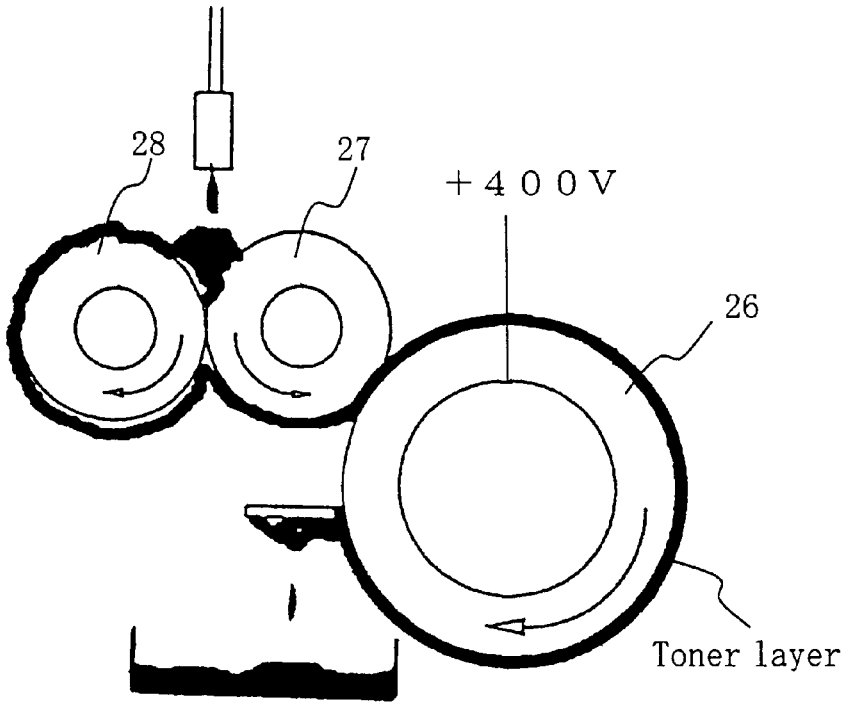
FIG. 2 is a diagram of assistance in explaining the operation of the applicator roller and the developing roller.

A plurality of the developing devices 14 are provided in one-to-one correspondence with yellow/magenta/cyan/black and biased to about 400 V to form a 2~5 μm-thick toner layer on the developing roller 26 by thinly spreading and transporting a liquid toner having a toner viscosity of 400~4000 mPa·s and a carrier viscosity of 10~500 cSt from the toner reservoir using a series of applicator rollers 27 and 28 constituting a developing solution applicator means, as shown in FIG. 2. The developing roller 26 deposits the toner on the exposed area (or unexposed area) of the photoconductive medium 10 statically charged to about 100 V by feeding the positively charged toner to the photoconductive medium 10 in accordance with the electric field between the developing roller 26 and the photoconductive medium 10.

The intermediate transfer medium 15 is biased to about −800 V, and the toner deposited on the photoconductive medium 10 is transferred on it in accordance with the electric field applied between the intermediate transfer medium 15 and the photoconductive medium 10. The yellow toner deposited on the photoconductive medium 10 is first transferred onto the intermediate transfer medium 15, and then the magenta, cyan and black toners deposited on the photoconductive medium 10 are sequentially deposited onto the intermediate transfer medium 15.

The blade 16 removes the toner and prewetting solution remaining on the photoconductive medium 10. The static eliminator 17 eliminates the charge on the photoconductive medium 10. The heating device 18 fuses the toner deposited on the intermediate transfer medium 15 by heating the surface of the intermediate transfer medium 15. The pressure roller 19 fixes the toner on the intermediate transfer medium 15 fused by the heating device 18 onto a printing medium. Thus, any printing media other than paper can be handled by adopting the construction where the toner deposited on the intermediate transfer medium 15 is fused and fixed onto a printing medium without heating the printing medium using the heating device 18 and the pressure roller 19.

In the wet-type electrophotography apparatus according to the present invention, an oil removal mechanism 30 is provided on the photoconductive medium 10 before transferring the toner onto the intermediate transfer medium 15, or an oil removal mechanism 20 is provided at a location in front of the heating device 18 on the intermediate transfer medium 15 after transfer, so as to remove excess oil, as will be described later. The term "oil" is used in this Specification where an oil may include both the prewetting solution and the liquid tone carrier solution. The method of transferring toner deposited on the photoconductive medium 10 to the intermediate transfer medium 15 and fusing and fixing the toner onto the printing medium by heating the intermediate transfer medium 15 has been widely used in handling color images owing to its advantage that passing the printing medium on the intermediate transfer medium 15 only once will suffice for the purpose. Although the present Specification deals with an embodiment having an intermediate transfer medium 15, the present invention is not limited to this, but may also be applied to methods of transferring the toner deposited on the photoconductive medium 10 directly on the printing medium without using the intermediate transfer medium 15.

Where a liquid toner having a viscosity as high as 400~4000 mPa·s is used as the developing solution, as in the case of the present invention, a silicone oil having a viscosity equal to, or lower than, that of a silicone oil used as the liquid toner is applied to the surface of the photoconductive medium 10 as the prewetting layer to give release properties in advance, with the developing roller 26 caused to make contact with the photoconductive medium 10 at such a contact pressure as not to destroy the prewetting layer, to prevent the toner from being deposited on the unexposed area of the photoconductive medium 10, as noted earlier.

This requires the developing device 14 to have such a construction that the amount of liquid toner and prewetting solution carried along with the revolution of the photoconductive drum 10 and the developing roller 26 should be passed through the contact portion between the photoconductive drum 10 and the developing roller 26. In addition, the hardness of the developing roller 26 should not be too high, more preferably not more than 60 degrees in terms of JIS-A hardness. The lower the hardness of the developing roller 26, the more the passable amount of liquid toner and prewetting solution increases. In this respect, it is desirable to use a sponge-like material.

In the meantime, it is desirable to keep the outer dimension accuracy and wobbling accuracy of the developing roller 26 as high as possible because the pressure exerted onto the liquid layer can be kept constant. With the developing roller 26 of a lower hardness, it become difficult to improve machining accuracy. It is therefore necessary to strike a balance between the hardness and the outer dimension accuracy of the developing roller 26.

The higher the revolution of the developing roller 26, the more the amount of liquid passing on the developing roller 26 increases, thereby relieving the pressure conditions. Increasing the revolution of the developing roller 26, however, has its own limitations because it reduces the time in which electric field is applied to the liquid toner, leading to a shortage in the time required to move the toner. The larger the diameter of the developing roller 26 the more the amount of liquid passing on the roller increases, relieving the pressure conditions. Increasing the diameter of the developing roller 26 has its own limitations because it makes it difficult to maintain the outer dimension accuracy.

Figure 4:
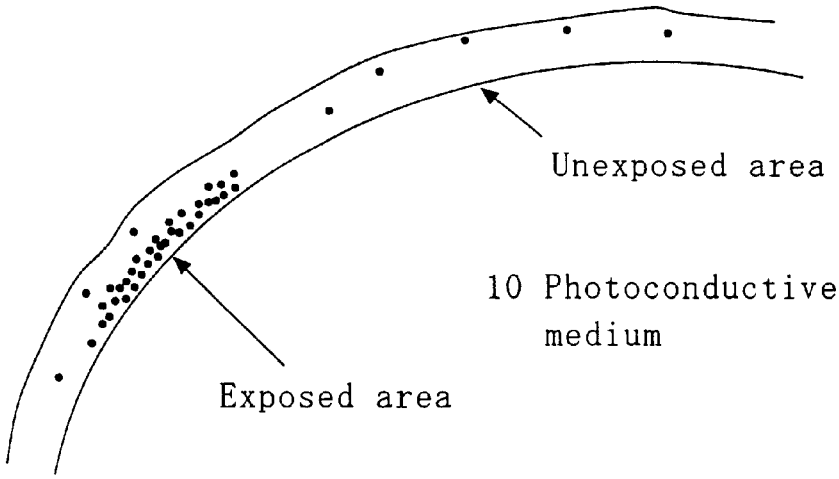
FIG. 4 is a diagram of assistance in explaining the state of the toner layer on the photoconductive medium after development.

FIG. 4 shows the state of the toner layer and the prewetting layer on the photoconductive medium 10 after development. As described earlier, the developing roller 26 supplies liquid developing solution on the photoconductive medium 10, depositing toner particles in the liquid developing solution on the photoconductive medium 10 in accordance with the electric field generated between the developing roller 26 and the photoconductive medium 10. Ideally, toner particles should be deposited only on the exposed area of the surface of the photoconductive medium 10, with no toner particles deposited on the unexposed area, after development. Also ideally, only the prewetting solution and the carrier of the liquid developing solution should be present and no toner particles should be on the side far from the surface of the photoconductive medium 10. It is necessary to remove the excess prewetting solution and the excess carrier solution on the side far from the surface of the photoconductive medium.

Heating of the intermediate transfer medium by the heating device 18 is performed only after the yellow toner deposited on the photoconductive medium 10 has been first transferred, and then all the magenta, cyan and black toners have been transferred to the intermediate transfer medium.

In other words, the toner on the intermediate transfer medium 15 is passed on the contact area between the photoconductive medium and the intermediate transfer medium prior to heating. At this time, the excess prewetting solution and the excess carrier solution may disturb the image as they are brought to the contact area between the photoconductive medium and the intermediate transfer medium, accumulate there and flow to the surfaces of the media. Furthermore, after the toner particles have been transferred to the intermediate transfer medium 15, the excess prewetting solution or carrier solution may adversely affect the heating and fusing of the toner layer during the fixing process. By removing the excess prewetting solution, the toner particles suspending therein that is prone to cause fogging can be removed.

Figure 5:
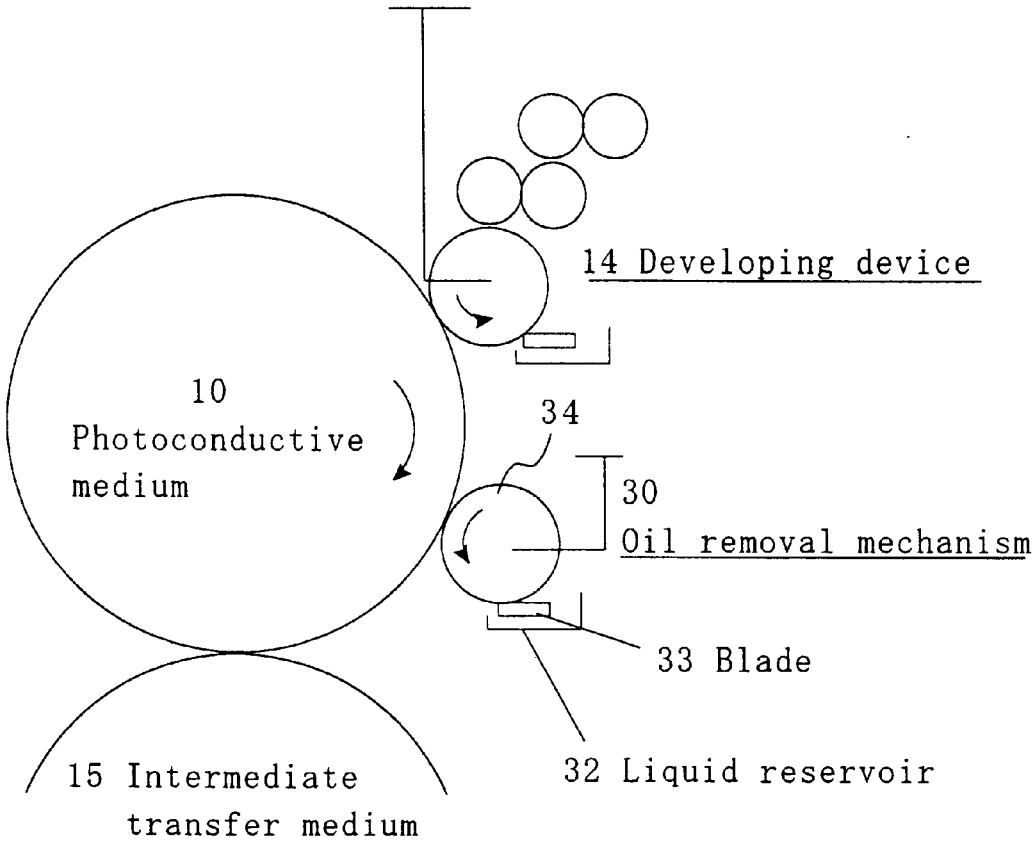
FIG. 5 is a diagram illustrating the construction of an oil removal mechanism provided on the photoconductive medium.

FIG. 5 is a diagram showing the details of the oil removal mechanism 30 provided on the photoconductive medium 10. As shown in the figure, the oil removal mechanism 30 is provided at a location after development on the photoconductive medium 10 and before transfer onto the intermediate transfer medium 15 or a medium, such as paper, and includes a removal roller 34 that comes in contact with the photoconductive medium 10 to rotate at the same speed. With this arrangement, the removal roller 34 coming in contact with the photoconductive medium 10 can remove the excess prewetting solution, the toner particles suspending therein, and the excess carrier solution.

The removal roller 34 may have a blade 33 and a liquid reservoir 32 so that the prewetting solution and the carrier solution removed from the removal roller 34 can be collected for recycling. The removal roller 34 can cause the developing toner layer on the surface of the photoconductive medium 10 by applying a bias voltage, which may be 400 V, almost the same level as the developing bias, or even higher than that. The higher the bias the better its effect is, but too high a bias would cause a discharge that may inadvertently charge the photoconductive medium or the toner, adversely affecting the image.

The removal roller 34 may be a roller having a surface roughness of Rz 5 $\mu$m, made of an electrically conductive urethane with a hardness of about JIS-A30°, for example, as will be described in detail later, referring to FIG. 7 so that the removal roller 34 can be brought into contact with the photoconductive medium without destroying the developing toner layer.

Figure 6:
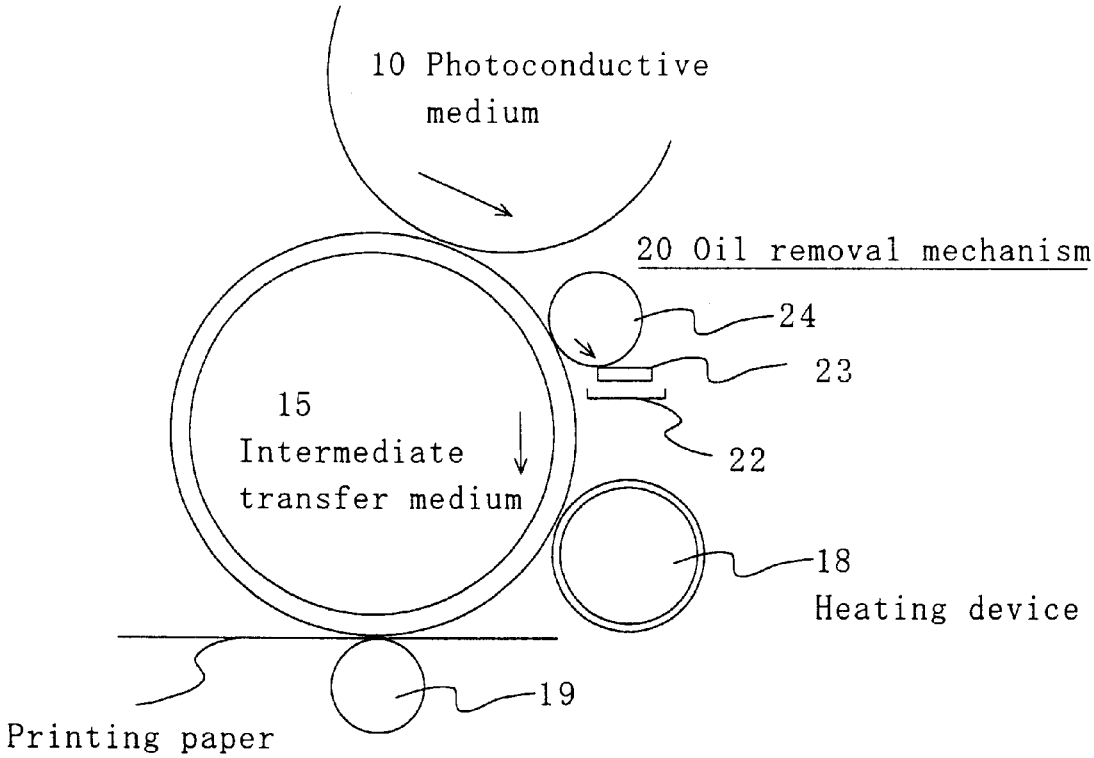
FIG. 6 is a diagram illustrating the construction of an oil removal mechanism provided on the intermediate transfer medium.

FIG. 6 shows the construction of an oil removal mechanism 20 provided on the intermediate transfer medium 15 for removing the excess prewetting solution and the excess carrier solution in the developing toner layer.

As shown in the figure, the oil removal mechanism 20 comprises an oil removal roller 24, which is disposed at a location in rear of the contact area between the photoconductive medium 10 and the intermediate transfer medium 15 and at a location prior to the heating of the intermediate transfer medium 15 by the heating device 18, serving as a rotating roller coming in contact with the intermediate transfer medium 15. With this arrangement, the oil removal roller 24 comes in contact with the intermediate transfer medium 15 at the same peripheral speed to remove the excess prewetting solution and the excess carrier solution. The oil removal roller 24 may be brought in contact with the intermediate transfer medium 15 at all times, or only once after all the color toners have been transferred.

The oil removal roller 24 may have a blade 23 and a liquid reservoir 22 to collect the prewetting solution and carrier solution removed by the oil removal roller 24 for recycling.

Figure 8:
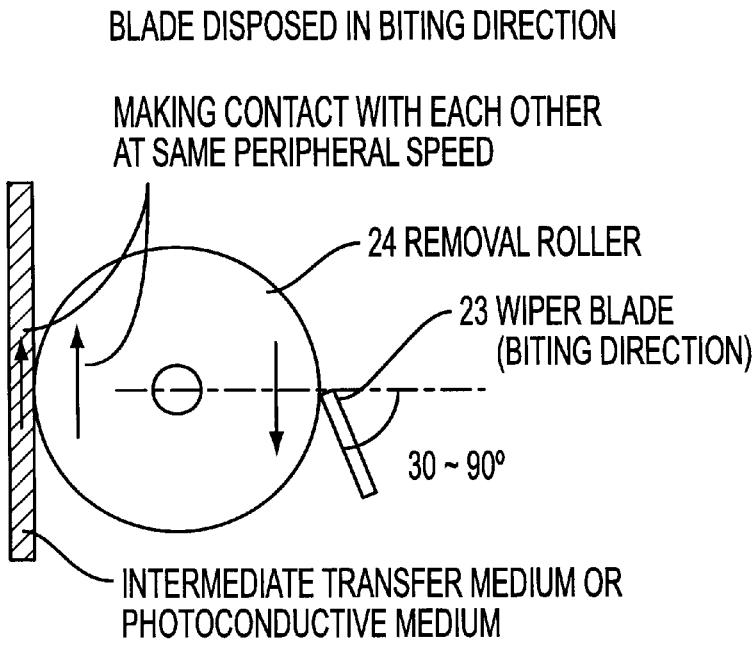
FIG. 8 shows the construction of a removal roller and related equipment for removing excess oil in the developing toner on the intermediate transfer medium or the photoconductive medium.
Figure 9:
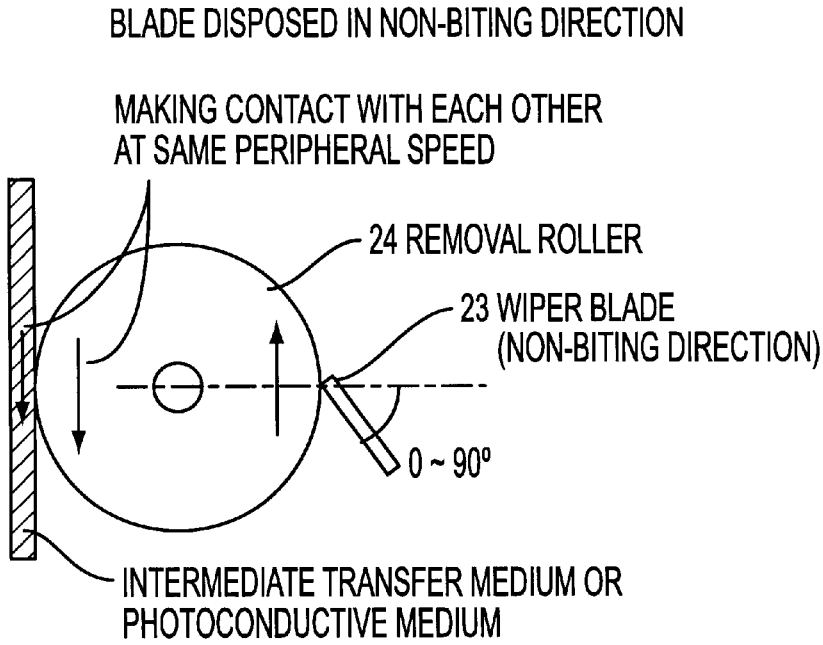
FIG. 9 shows another example of the construction of a removal roller and related equipment for removing excess oil in the developing toner on the intermediate transfer medium or the photoconductive medium.

FIGS. 8 and 9 are diagrams of assistance in explaining the operation of a removal roller 24 provided on the intermediate transfer medium or the photoconductive medium, and a wiper blade for collecting the removed prewetting solution and carrier solution. Before the photoconductive medium 10 comes in contact with the intermediate transfer medium 15, the removal roller 24 makes contact with the photoconductive medium 10 and after the photoconductive medium 10 has come in contact with the intermediate transfer medium 15, it makes contact with the intermediate transfer medium 15 at a location before the intermediate transfer medium 15 is heated by the heating device 18. With this, the removal roller 24 can remove the excess carrier solution by making contact with the photoconductive medium 10 or the intermediate transfer medium 15.

The removal roller 24 rotates at the same peripheral speed as that of the photoconductive medium or the intermediate transfer medium with which it makes contact, causing the prewetting solution and the carrier solution to adhere onto the removal roller 24 for removal. Since a bias voltage is applied to the removal roller 24 when removing the prewetting solution and the carrier solution, as will be described later, there is no fear of disturbing the image. As the removal roller 24, a resin- or rubber-based material (ebonite such as urethane rubber and nitrile rubber, or resin such as polyacetal, for example) may be used to ensure a soft contact with the photoconductive medium 10 or the intermediate transfer medium 15.

In place of the removal roller 24, a belt connecting at least two rollers may be used to cause the prewetting solution and the carrier solution to adhere onto the belt for removal by rotating the belt at the same peripheral speed as that of the photoconductive medium or the intermediate transfer medium. As the removal belt, a resin-based material (such as polyether imide, polyimide, etc.) having good dimensional stability may be used. By causing the belt to make contact with the photoconductive medium or the intermediate transfer medium at a location between the rollers inside the belt, a soft contact with the photoconductive medium or the intermediate transfer medium can be achieved. In addition, there is no fear of disturbing the image since a bias voltage is applied to the removal belt, as will be described later.

A bias voltage is applied to the oil removal mechanism comprising the removal roller 24 or removal belt to allow only the prewetting solution and the carrier solution to migrate to the roller or belt from the photoconductive medium or the intermediate transfer medium while preventing the toner particles from migrating. A bias voltage of the range of some hundreds of volts~several kilovolts is applied to the oil removal mechanism in the same polarity as that of the statically charged toner. If the toner is positively charged by applying a voltage of −500 V to the intermediate transfer medium 15, a bias voltage of −100 V~+3 kV is applied to the removal roller 24 (both a positive voltage and −100 V are relatively of the same polarity when compared with −500V). To ensure the effective operation of the bias voltage applied to the oil removal mechanism, the removal roller 24 or belt should preferably be made of an electrically conductive material having a resistance of not less than $10^8\Omega$, more desirably approximately $10^8$~$10^9\Omega$ to keep the current value flowing into the photoconductive medium below 10 $\mu$A.

To enable the prewetting solution and the carrier solution and a trace amount of toner adhering to the removal roller 24 to be collected for recycling, the removal roller 24 has a wiper blade 23 made of rubber, or resin, or edge-rounded spring steel, and a liquid reservoir (not shown).

The wiper blade 23 shown in FIG. 8 can have an edge surface making contact with the removal roller 24 disposed in the direction to bite the roller surface (preferably in the range of 30~90° with respect to the direction perpendicular to the roller surface) in relation to the rotating direction of the removal roller 24. The wiper blade 23 in this arrangement should preferably be made of rubber.

The wiper blade 23, to the contrary, may be disposed in the direction not to bite the roller surface (in the range of 0~90° with respect to the direction perpendicular to the roller surface), as shown in FIG. 9.

To completely scrape off a trace amount of toner adhering to the oil removal mechanism comprising the removal roller 24 or removal belt, an electrically conductive material (a resin- or rubber-based conductive material having a volume resistance of under $10^6\Omega$, or an edge-rounded spring steel) is used as the wiper blade 23, and a bias voltage is applied to the blade. At this time, the bias voltage applied to the blade should be of the range of some hundreds of volts~several kilovolts in the negative polarity with respect to the removal mechanism for the positively charged toner, and in the positive polarity with respect to the removal mechanism for the negatively charged toner. It was confirmed that when a bias voltage of 3 kV is applied to a roller made of urethane resin having a resistance of $10^8$~$10^9\Omega$, for example, 30~35% of the carrier solution could be removed from the image after primary transfer having a solids content of 30%.

After long hours of service, the scraped toner may build up between the wiper blade and the removal mechanism, lowering the toner scraping performance of the blade. To prevent this, a blade cleaning mechanism 25 is disposed to clean the blade.

Figure 10:
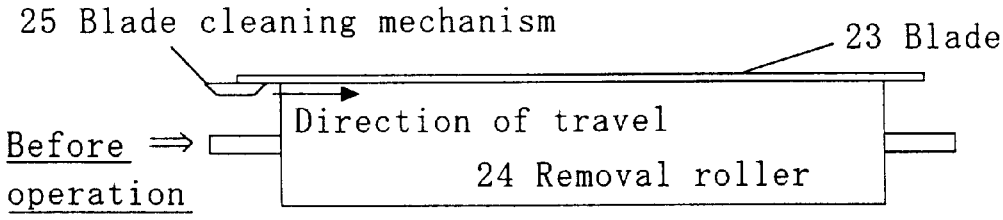
FIG. 10 shows an example of a wiper blade cleaning mechanism.
Figure 10:
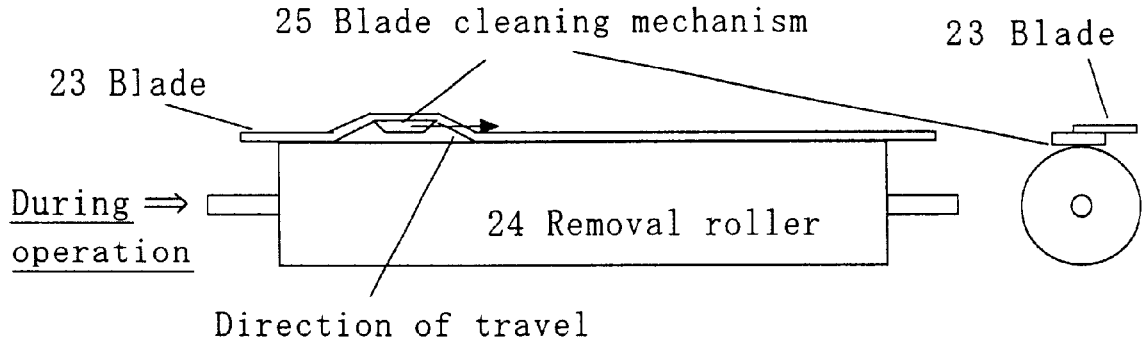

FIG. 10 illustrates an example of such a wiper blade cleaning mechanism. (a) in the figure shows the state before operation. A wiper blade of a length exceeding the overall axial length of the roller-type removal mechanism makes contact with the removal mechanism in the aforementioned positional relationship. Before operation, the blade cleaning mechanism is in a standby position at an end in the lengthwise direction of the roller.

FIG. 10 (*b*) shows the blade cleaning mechanism in operation. The blade cleaning mechanism 25 enters into the gap between the removal roller 24 and the wiper blade 23 and scrapes off the toner accumulated between the removal roller 24 and the wiper blade 23 as it reciprocates in the lengthwise direction of the removal roller 24.

Figure 7:
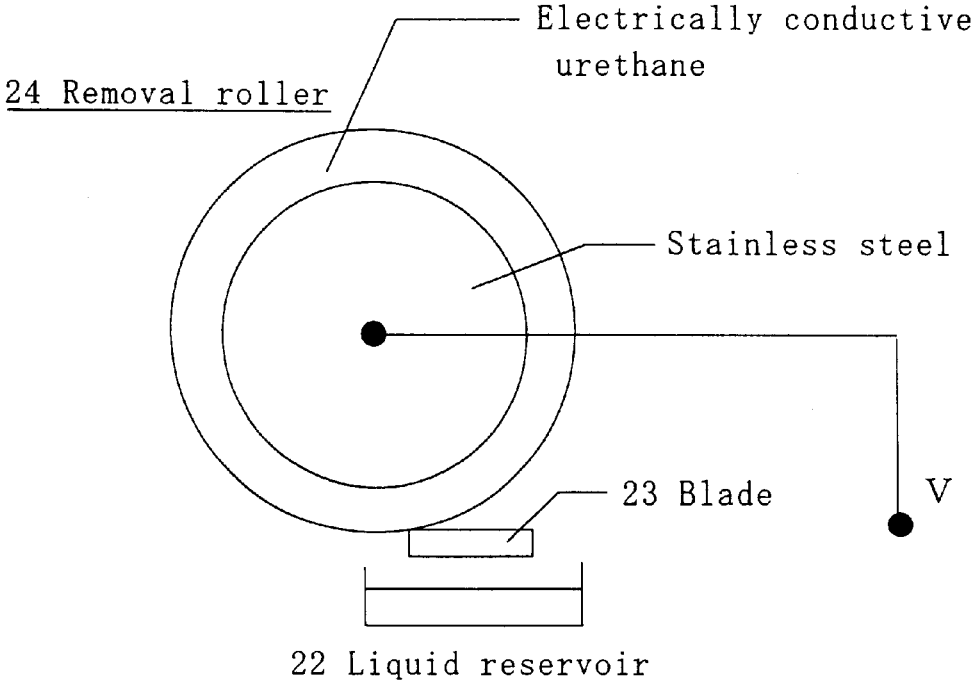
FIG. 7 is a diagram illustrating the construction of an oil removal roller.

FIG. 7 shows the detailed configuration of an example of the oil removal mechanism. The removal roller 24 is an elastic roller having a blade 23, made of urethane rubber, for example, that makes contact with the removal roller 24 in the direction opposite to the rotating direction of the removal roller 24, as shown in the figure, to remove the oil adhering to the removal roller 24.

As the removal roller 24, an urethane roller having a hardness of JIS-A30° provided around a stainless steel core can be used. It was confirmed that about 40% of the oil could be removed on the photoconductive medium and about 30% of the oil on the intermediate transfer medium without lowering image quality by causing this roller to make soft contact with the photoconductive medium and the intermediate transfer medium. Furthermore, by heating the toner image on the intermediate transfer medium and fusing it into a film, the oil entrapped in between toner particles rises to the surface of the toner image, making it possible to efficiently remove the oil.

The developing toner layer can be aggregated on the surface of the photoconductive medium or the intermediate transfer medium by making the removal roller 24 electrically conductive and applying a bias of relatively the same polarity as that of the toner particles so as not to attract the toner particles. In this way, only the oil on the photoconductive medium or the intermediate transfer medium can be removed.

Figure 11:
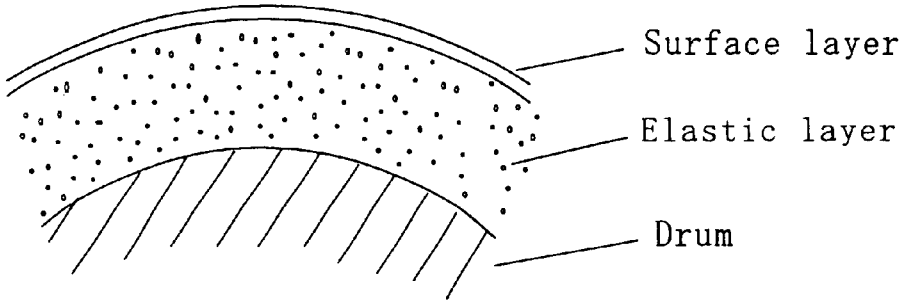
FIG. 11 shows an example of the construction of an intermediate transfer medium constituting a wet-type electrophotography apparatus.

FIG. 11 shows an example of the construction of the intermediate transfer medium suitable for use together with the aforementioned oil removal mechanism 20. The roller-type intermediate transfer medium shown in the figure has a rigid drum made of a metal, such as aluminum, at the center thereof. This drum has electrical conductivity so that voltage can be applied from the shaft, etc. to transfer the toner image on the photoconductive medium to the intermediate transfer medium by the force of static electricity, and a hardness enough to exert pressure necessary to fuse and transfer the toner on the intermediate transfer medium to a printing medium, such as paper. On the drum provided are an elastic layer having electrical conductivity and heat resistance, and a surface layer having electrical conductivity, heat resistance, release properties, and preferably resistance to silicone oil.

With this configuration, the heat capacity of the entire assembly and therefore the supply of heat can be reduced, while the surface temperature can be easily increased. Furthermore, reduced heat capacity helps improve the cooling performance of the intermediate transfer medium after the fused toner has been transferred to a printing medium, such as paper, eliminating the need for heating the photoconductive medium.

Figure 12:
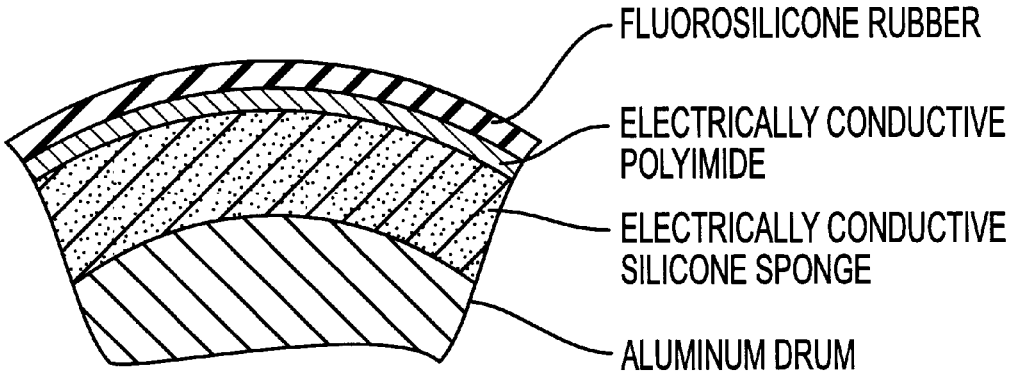
FIG. 12 shows another example of the construction of an intermediate transfer medium constituting a wet-type electrophotography apparatus.

The surface layer can be a 10~50 $\mu$m-thick electrically conductive, heat-resistant polyimide film coated with fluorosilicone rubber, as shown in FIG. 12. With this construction, the intermediate transfer medium acts as an elastic body by resiliency of the electrically conductive silicone sponge and fluorosilicone rubber when making contact with the photoconductive medium during primary transfer, while the sponge portion of the intermediate transfer medium is compressed sufficiently to give full play to the rigidity of the aluminum roller to impart sufficient pressure when making contact with the heat belt or the backup roller.

Figure 13:
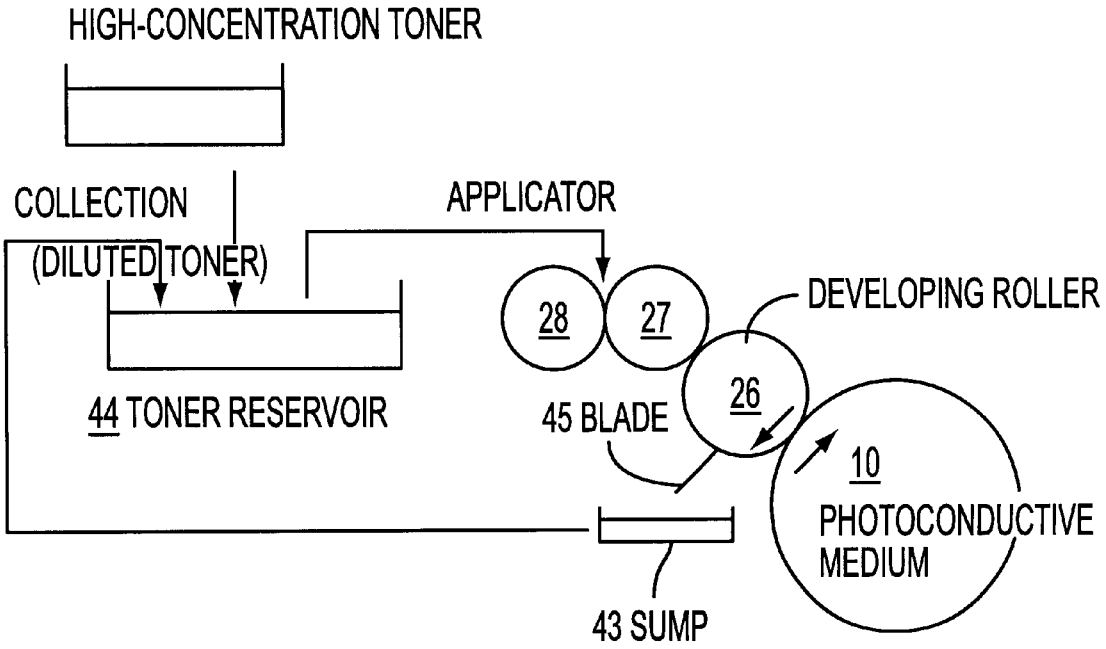
FIG. 13 shows a construction for recovering and recycling developing solution.

FIG. 13 shows an example of collecting developing agent for recycle. The liquid toner utilized by the present invention is obtained by dispersing solid particles (pigments, etc.) in an insulating liquid (carrier solution), and has a viscosity as high as 100~10000 mPa·s. This liquid toner is applied to a developing roller 26 in a thin layer of 1~50 $\mu$m to feed to a developing gap portion as the liquid developer.

The liquid developer remaining on the developing roller 26 after passing through the developing gap portion is scraped off by a blade 45 and accumulated in a sump 43. The liquid developer is diluted as solid particles migrate on the photoconductive medium 10, and further diluted as a prewetting oil is mixed with it.

This diluted liquid developer is sent to the toner reservoir 44 using a pump, etc. In the toner reservoir 44, a high-concentration toner, which will be described in detail later, is supplied and mixed with the diluted toner to obtain a liquid toner having a predetermined concentration. The liquid toner of a predetermined concentration is supplied to the developing roller 26 from the toner reservoir 44 while being spread into a thin film by an applicator comprising rollers 27 and 28. With this, the aforementioned developing operation can be carried out.

Figure 14:
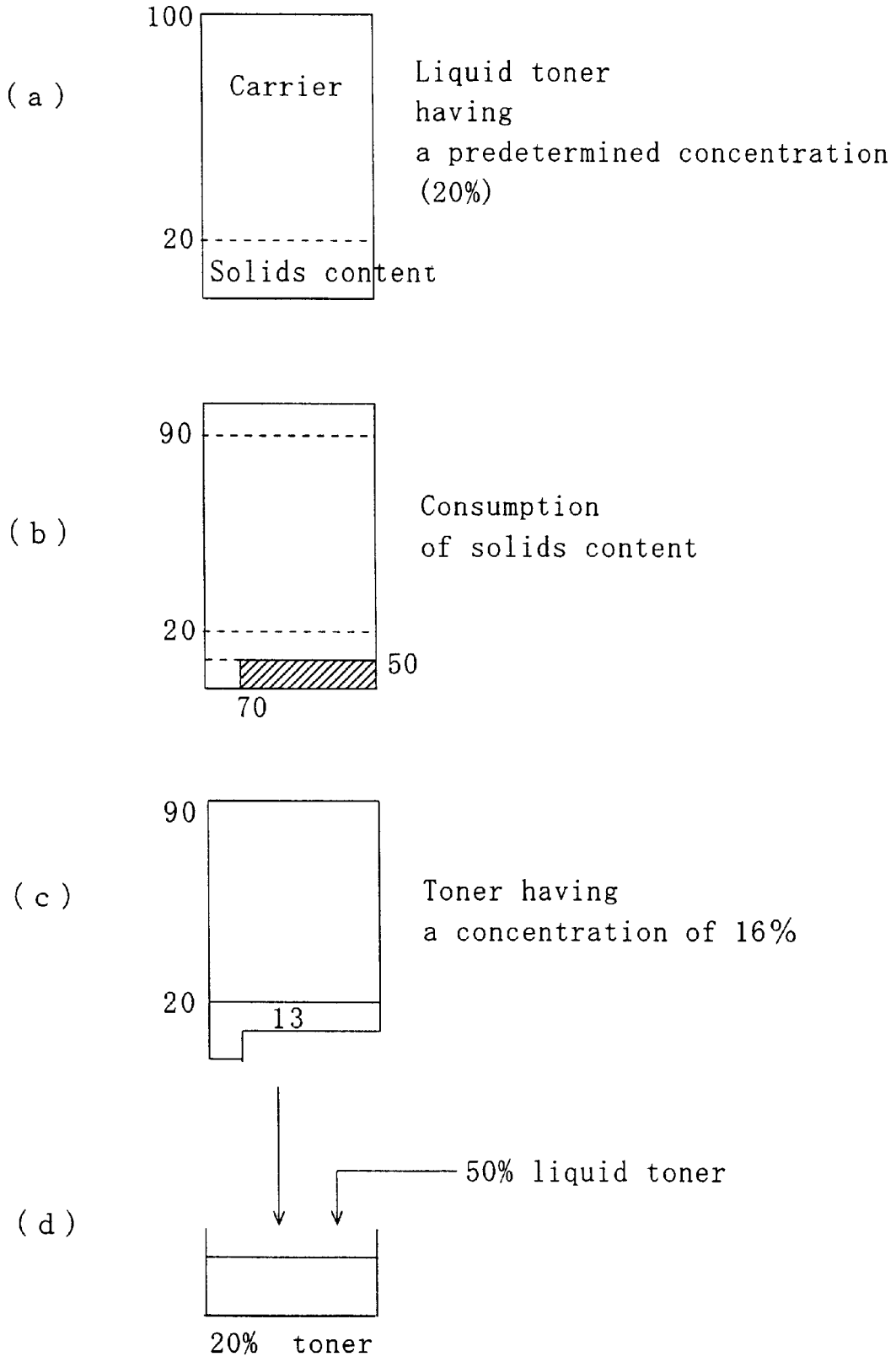
FIG. 14 is a diagram of assistance in explaining the mixing of recovered diluted toner with high-concentration toner.

FIG. 14 is a diagram of assistance in explaining the mixing of the recovered diluted toner and the high-concentration toner in the toner reservoir shown in FIG. 13.

Now, assume that a liquid toner having a solids content of 20% is used as the liquid developer in a wet-type electrophotography printer, with a carrier solution of the liquid toner consumed at an almost constant rate of 10% and the consumption of the solids content depending on developing efficiency and printing duty.

FIG. 14 (*a*) shows a liquid toner of a predetermined concentration (20%), with a solids content of 20% and a carrier content of 80%. It is known that when such a liquid toner is used as the liquid developer in a wet-type electrophotography printer, the image developing efficiency is approximately 70%. At this time, when the printing duty is assumed to be 50%, what is equivalent to 70% (developing efficiency) of 50% (printing duty) of the 20% solids content is consumed, as shown by a hatched portion in FIG. 14 (*b*). Thus, 10% of the carrier solution is consumed, as mentioned earlier, while 13% of the 20% solids content is recovered and 7% of the initial amount is consumed. Consequently, the recovered liquid toner is a liquid toner diluted to 16%, as shown in (*c*) of the figure.

When a high-concentration toner of a concentration of 50% is replenished to the toner diluted to 16%, as shown in (*d*), the concentration of the toner in the toner reservoir 44 can be kept at the initial 20% by replenishing the high-concentration toner of an amount equal to less than 20% of the consumed toner.

In this way, the amount of high-concentration toner of a known concentration to be replenished to the toner reservoir 44 can be obtained by knowing printing duty for each color in a printer using a developing device using a known solids content for each color toner and a known image developing efficiency, as in the above example. Instead of replenishing a high-concentration toner, as described above, the carrier solution and the solids content can be replenished separately to make up for their respective amounts consumed. Even with this arrangement, the liquid toner can be kept at a predetermined concentration.

Figure 15:
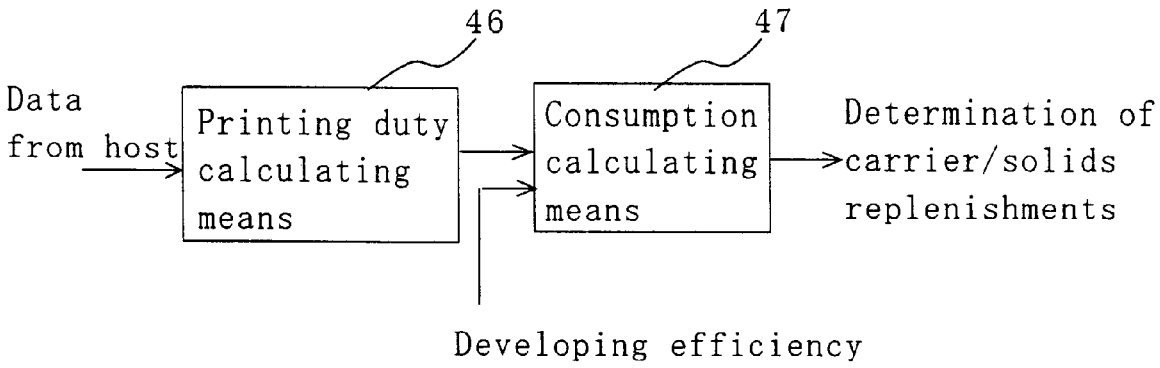
FIG. 15 is a schematic diagram of a means for determining the amount of replenishment of toner.

FIG. 15 is a schematic diagram of a means for determining the amount of toner replenishment according to the present invention. A printing-duty calculating means 46 determines the printing duty by calculating the printing duty for each color prior to printing whenever the data from the host is rasterized by the printer, or at the point of time when the bitmap data is received directly. A toner consumption calculating means 47 determines the amount of toner consumption either in the replenishment of high-concentration toner based on the printing duty for each color and the image developing efficiency, or in the separate replenishment of the carrier solution and the solids content. This allows the concentration of the toner in the toner reservoir to be kept constant without providing in the liquid toner container a sensor for detecting the concentration of the carrier solution in the liquid toner.

Figure 16:
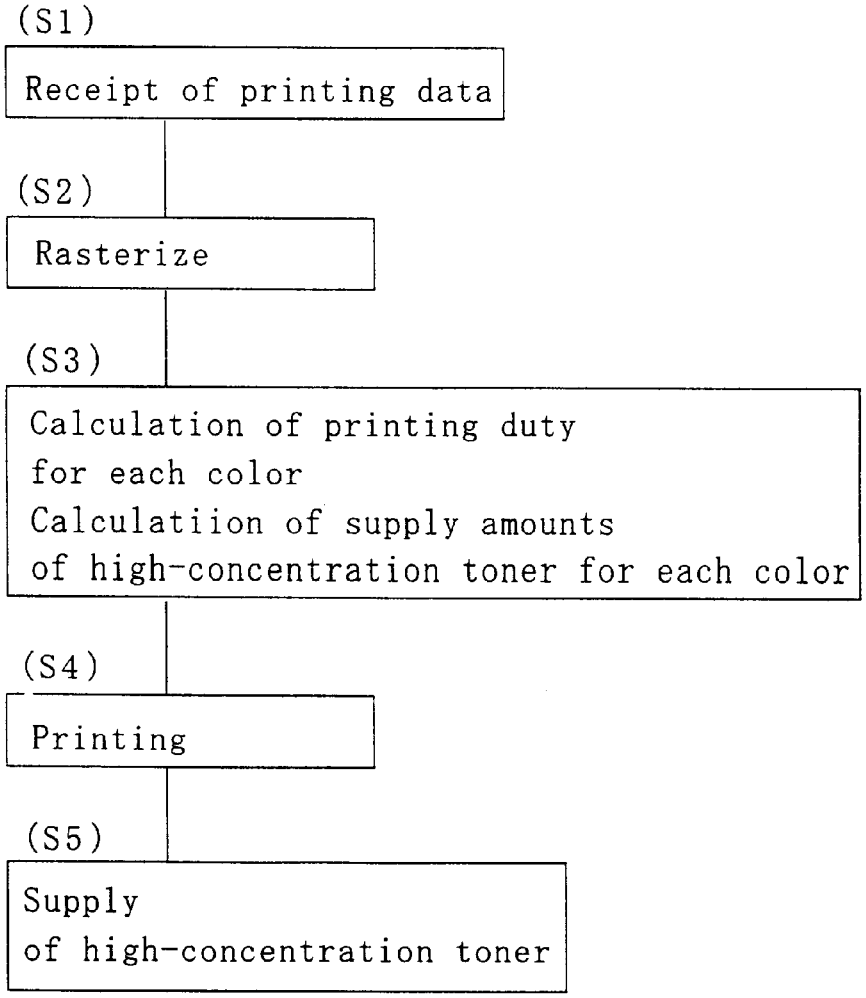
FIG. 16 is a flow chart for explaining printing operation.

FIG. 16 is a flow chart of assistance in explaining the printing operation. In Step S1, the printer receives printing data from the host. In Step S2, the printing data is rasterized, or arrangement is made to enable bitmap data to be received directly from the host, as described above. In Step S3, the printing duty for each color is calculated prior to printing to calculate the supply of high-concentration toner for each color. Printing is then carried out in Step S4, and the amount of high-concentration toner calculated above is supplied in Step S5. Arrangement can also be made so that the amounts consumed of the carrier solution and the solids content can be replenished separately, as described above.

Figure 17:
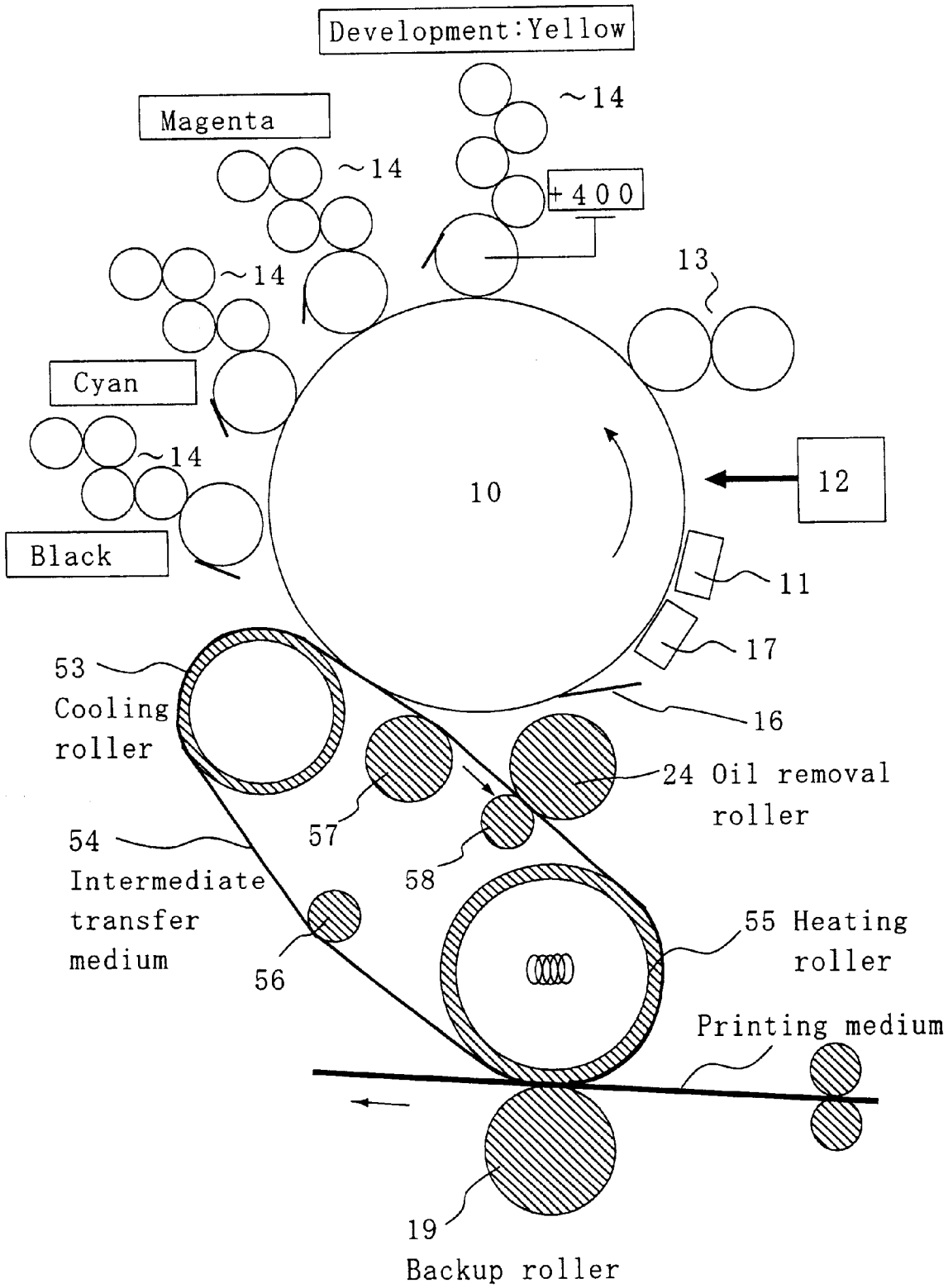
FIG. 17 is a general view of another example of a wet-type electrophotography apparatus embodying the present invention that is different from FIG. 1.

FIG. 17 is a diagram showing the overall construction of another example of a wet-type electrophotography apparatus that is different from that shown in FIG. 1. Description of the same parts as those shown in FIG. 1 is omitted here. An intermediate transfer belt 54 as the intermediate transfer medium is biased at about −1500 V to transfer the toner particles deposited on the photoconductive medium 10 in accordance with the electric field between the belt 54 and the photoconductive medium 10. The toner particles for each of four colors are transferred four times from the photoconductive medium 10 to the intermediate transfer belt 54. The yellow tone particles deposited on the photoconductive medium 10, for example, is first transferred, and then the magenta, cyan and black toner particles are sequentially transferred from the photoconductive medium 10 to the intermediate transfer belt 54. After that, the toner particles transferred onto the intermediate transfer belt 54 are heated, and fused and transferred onto a printing medium, such as paper, in a single operation. At this time, a backup roller 19 makes contact with a heating roller 55 to exerts pressure so that the fused toner particles are fused on a printing medium, such as printing paper.

The intermediate transfer belt 54 connects a plurality of tension rollers 56 and 57, a heating roller 55 having a heating mechanism, and a cooling roller 53. Although the intermediate transfer belt 54 can be driven by any roller, the hearing roller 55, for example, may be equipped with a driving mechanism. The heating roller 55 may comprise an aluminum roller that can be heated by a heat source, such as a halogen lamp provided inside the roller. An oil removal roller 24 making contact with the surface of the intermediate transfer belt 54 is provided between the position of the intermediate transfer belt 54 at which the intermediate transfer belt 54 comes in contact with the photoconductive medium 10 and the heating roller 55. The oil removal roller 24 is biased at +3 kV, for example, to remove not only the excess carrier solution but also the prewetting solution.

An electrically conductive roller 58 making contact with the inside of the intermediate transfer belt 54 at a location facing the oil removal roller 24 may be provided. By grounding the electrically conductive roller 58 via the intermediate transfer belt 54, with the result that a bias voltage can be applied to the oil removal roller 24 without causing electrical effects on static transfer, fused transfer and other processes.

The intermediate transfer belt 54 is subjected to repeated heating/cooling cycles since the surface of the intermediate transfer belt 54 according to the present invention is heated to 150° C. by a heating mechanism (heating roller 55 ), for example, while cooled to 40° C. by a cooling device (cooling roller, for example). This arrangement prevents the photoconductive medium 10 from being affected by the heating of the intermediate transfer medium (belt), the photosensitivity thereof from deteriorating.

Embodiment 1

Development was carried out by bringing a developing roller coated with 3.0 g/m$^2$ (about 3 $\mu$m in thickness) of a liquid developer obtained by dispersing 25 wt. % of toner particles comprising a resin and pigments in a 20-cSt silicone oil (Toray-Dow Corning SH200-20) as a carrier solution in contact with a photoconductive medium coated with 2 g/m$^2$ (about 4 $\mu$m in thickness) of a silicone oil (Toray-Dow Corning SH344) having a viscosity of 2.5 cSt as a prewetting agent, and applying 400 V. The developing roller is a PFA tube-covered sponge roller having a hardness of ASKA C30 degree specially designed to ensure a soft contact with the photoconductive medium. Observation results of image areas (exposed areas) and non-image areas (unexposed areas) on the photoconductive medium during development are shown in Table 1 below.

TABLE 1

| | | Where no oil removal roller was used | | | |
|---|---|---|---|---|---|
| | | Amount of prewetting solution | Amount of carrier solution | Total amount of oil | Solid content |
| Before development | On developing roller | | 2.25 g/m$^2$ | 2.25 g/m$^2$ | 0.75 g/m$^2$ |
| | On photoconductive medium | 4.2 g/m$^2$ | | 4.2 g/m$^2$ | |
| After development | On developing roller (residual toner content) | 1.1 g/m$^2$ | 0.9 g/m$^2$ | 2.0 g/m$^2$ | 0.15 g/m$^2$ |
| | On photoconductive medium (image areas) | 3.2 g/m$^2$ | 1.3 g/m$^2$ | 4.5 g/m$^2$ | 0.5 g/m$^2$ |
| | On photoconductive medium (non-image areas) | 2.4 g/m$^2$ | 0.5 g/m$^2$ | 2.9 g/m$^2$ | 0.1 g/m$^2$ |

Next, a roller having the same construction as the developing roller was used as an oil removal roller. After development, the removal roller was brought in contact with the photoconductive medium while being rotated at the same peripheral speed as the photoconductive medium, and a bias voltage of 400 V was applied to the removal roller. Observation results of fogging on the non-image areas on the photoconductive medium are shown in Table 2 below.

As is evident from the measurement results, the amounts of fog, the prewetting solution and the carrier solution were reduced by providing a removal roller at a position after development, The solids content on the non-image areas on the photoconductive medium, for example, which was originally to be zero, was reduced to 0.05 g/m$^2$ in Table 2 where a removal roller was provided, whereas the corresponding value was 0.1 g/m$^2$ in Table 2 where no removal roller was provided. Similarly, the amounts of the prewetting solution and the carrier solution on the image and non-image areas on the photoconductive medium were reduced substantially in the embodiment having a removal roller, compared with that having no removal roller.

TABLE 2

| | | Where a removal roller was provided | | | |
|---|---|---|---|---|---|
| | | Amount of prewetting solution | Amount of carrier solution | Total amount of oil | Solid content |
| Before development | On developing roller | | 2.25 g/m$^2$ | 2.25 g/m$^2$ | 0.75 g/m$^2$ |
| | On photoconductive medium | 4.2 g/m$^2$ | | 4.2 g/m$^2$ | |
| After development | On photoconductive medium (image areas) | 1.91 g/m$^2$ | 0.59 g/m$^2$ | 2.5 g/m$^2$ | 0.45 g/m$^2$ |

TABLE 2-continued

| | | Where a removal roller was provided | | | |
|---|---|---|---|---|---|
| | | Amount of prewetting solution | Amount of carrier solution | Total amount of oil | Solid content |
| | On photoconductive medium (non-image areas) | 1.38 g/m$^2$ | 0.2 g/m$^2$ | 1.58 g/m$^2$ | 0.05 g/m$^2$ |

Embodiment 2

Next, an embodiment where a removal roller was provided on an intermediate transfer medium (IMR) will be described. Using a developing roller coated with 5 g/m$^2$ of the toner layer by applying a liquid toner having 25 wt. % of toner particles dispersed in a carrier solution, and a photoconductive medium coated with a 4 $\mu$m thickness of silicone oil having a viscosity of 20 cSt as the prewetting solution, development was carried out, and the toner image obtained was transferred onto an intermediate transfer medium, which is an 80 $\mu$m-thick sheet obtained by applying electrically conductive PFA to an electrically conductive polyimide film. After the toner image was transferred onto the intermediate transfer medium, an electrically conductive urethane roller having a resistance of $10^6\Omega$ and a surface roughness of less than 5 $\mu$m was brought into contact with the IMR at the same peripheral speed, and a bias voltage of +2 kV (IMR −300 V) was applied. The toner content on the IMR at this time changed with the number of oil removal operations, as shown in Table 3 below.

TABLE 3

| | | Amount of oil | Oil removal rate | Amount of solids in toner | Solids content |
|---|---|---|---|---|---|
| Before oil removal | On IMR | 0.19 g | | 0.10 g | 34.5% |
| After oil removal On IMR | Once | 0.13 g | 31% | 0.10 g | 43.5% |
| | Twice | 0.10 g | 23% | 0.10 g | 50% |
| | 3 times | 0.09 g | 10% | 0.10 g | 52.6% |
| | 4 times | 0.08 g | 11% | 0.10 g | 55.6% |
| | 5 times | 0.08 g | 0% | 0.10 g | 55.6% |

These results reveal that about 30% of oil can be removed with a single oil removal operation on the intermediate transfer medium, indicating the effectiveness of the oil removal means according to the present invention. These test results also reveal, however, that the oil removal effects could be reduced when the solids content exceeds 50%. After repeating tests of heating and fusing toner on the intermediate transfer medium under these circumstances, it was found that the oil content entrapped in between the toner particles is brought to the surface as the toner is heated and fused. That is, the oil content in the toner image can be further removed by performing oil removal in this state. Table 4 below shows the results of tests in which oil removal was performed twice at normal temperatures, and then oil removal after heating and cooling was carried out three times.

TABLE 4

| | | Amount of oil | Amount of solids in toner | Solids content |
|---|---|---|---|---|
| Before oil removal | On IMR | 0.19 g | 0.10 g | 34.5% |
| After oil removal On IMR | Once (normal temp.) | 0.15 g | 0.10 g | 40% |
| | Twice (normal temp.) | 0.13 g | 0.10 g | 43.5% |
| | 3 times (after heating) | 0.07 g | 0.10 g | 58.8% |
| | 4 times (after heating) | 0.04 g | 0.10 g | 71.4% |
| | 5 times (after heating | 0.03 g | 0.10 g | 77% |

Figure 18:
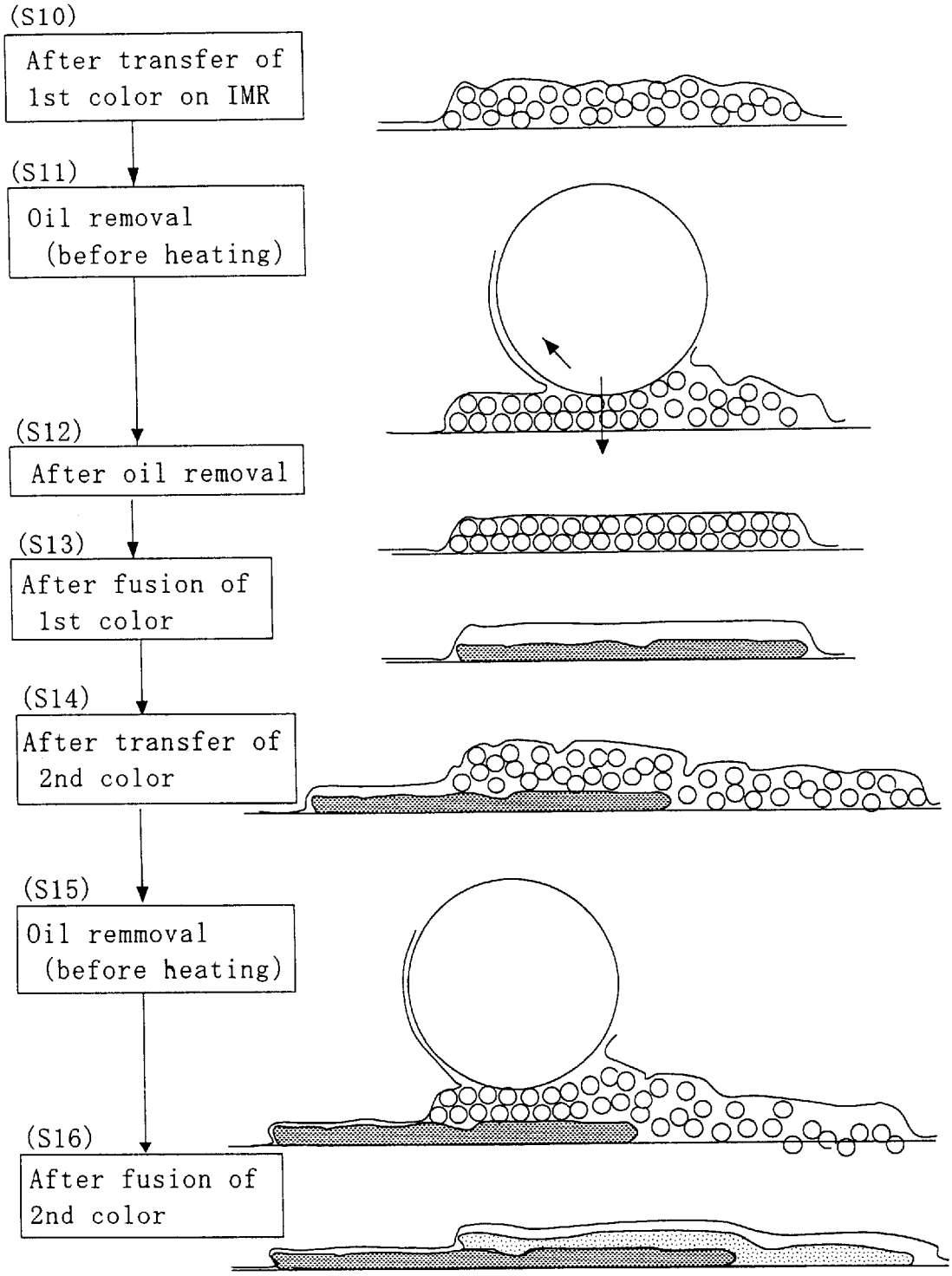
FIG. 18 is a conceptual diagram illustrating changes in the state of the toner layer on the intermediate transfer medium (IMR), and the condition of oil removal.

These test results indicate that oil can be removed down to nearly 80% of solids content by removing oil after heating and fusing. The 4-color printing sequence in a device shown in FIG. 1 or 17 will be described, referring to FIG. 18 which is a conceptual diagram illustrating changes in the state of toner on the intermediate transfer medium (IMR), and the state of oil removal. The toner for a first color is first developed and transferred onto the IMR (S10), and then oil is removed (S11). The state after oil removal is shown in Step S12. After that, the solids content of toner is heated and fused in the heating device to reduce it to a film (S13). The toner for a 2nd color is then developed, transferred and superposed (S14), and oil is removed again (S15). Step S16 shows the state after the toner for the 2nd color is fused. By repeating this sequence for 3rd and 4th colors, oil removal can be carried out while overprinting colors.

In this way, the most efficient oil removal can be accomplished by providing an oil removal roller making contact with the toner on the IMR, combining with a means for heating and fusing the toner, and carrying out oil removal after fusing.

Embodiment 3

Next, the state where non-volatile oil is used as the prewetting agent will be described in the following.

A liquid toner obtained by dispersing 20 wt. % of toner particles having an average particle size of 1 μm in Toray-Dow Corning silicone oil SH200-20 cSt was used. The liquid toner also contained additives, such as dispersing agent and chemical destaticizer. The viscosity of the liquid toner changes with the content of dispersing agent. The term viscosity used here refers to the viscosity at a point where the viscosity curve remains constant within the slip speed range of approximately 500~3000/s. As the prewetting agent, Toray-Dow Coming silicone oil SH344(2.5 cSt) and non-volatile SH200-20 cSt were used. 4~5 μm of these two prewetting solutions were applied to the photoconductive medium, and the development results were compared.

The operating principle of toner development in most of the conventional wet-type electrophotography has been proven and analyzed by electrophoresis that is caused by an electric field formed between developing electrodes. As shown by the equation, $V=QE/6\pi\eta$ (where V: electrophoresis speed of particles, Q: charge of particles, E: external field, η: viscosity of liquid, a: particle size), the migration speed of toner particles is in inverse proportion to the viscosity of the liquid. It is evident therefore that increased viscosity works against any high-speed development that is governed by the principle of electrophoresis.

Figure 19:
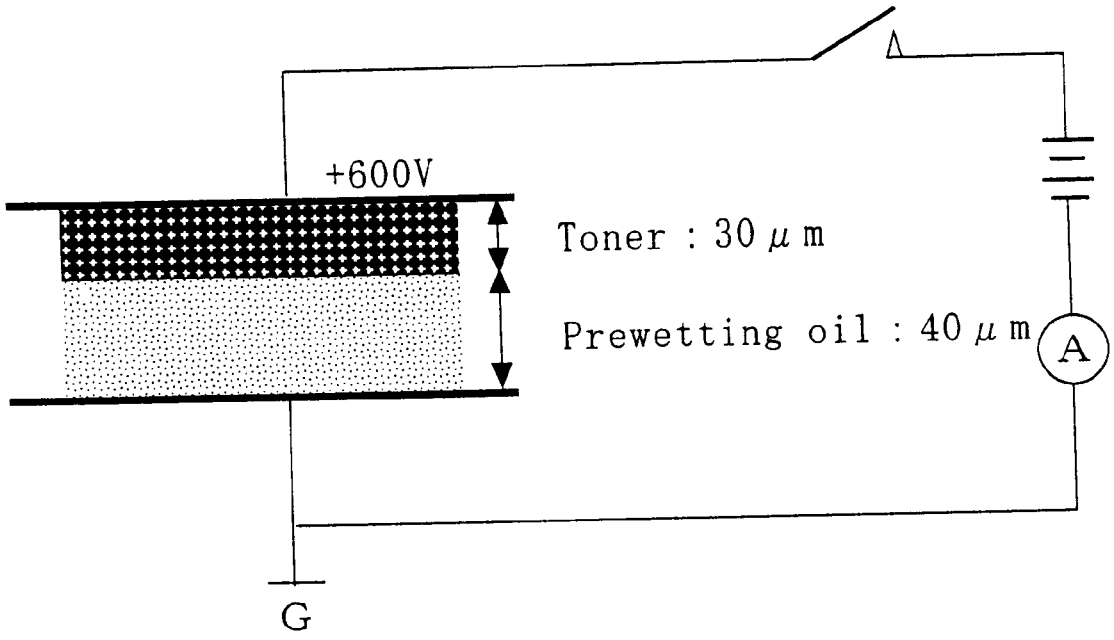
FIG. 19 is a diagram of assistance in explaining the principle of toner development in wet-type electrophotography through preliminary experiments.

As preliminary tests, 30 μm of a developing agent containing 20 wt. % of toner solids and 40 μm of silicone oils having different viscosity values of 2.5 cSt and 20 cSt were placed between two parallel flat electrodes having a gap of 70 μm, as shown in FIG. 19, and waveform peaks of the toner migration current generated when a 600-V bias voltage was applied across the electrodes were measured for comparison. As shown in Table 5, the results clearly reveal some delay in the peaks of the migration current when the silicone oil of 20 cSt was used. This was attributed to the fact that an increase in the viscosity of a liquid reduces the migration speed of particles under the same toner/external field intensity conditions. It can be said that migration of toner particles under these test conditions is an operation mode consistent with the principle of electrophoresis.

TABLE 5

| Viscosity of prewetting oil | Peak time of toner migration current |
|---|---|
| 2.5 cSt | 39 ms |
| 20 cSt | 600 ms |

Figure 20:
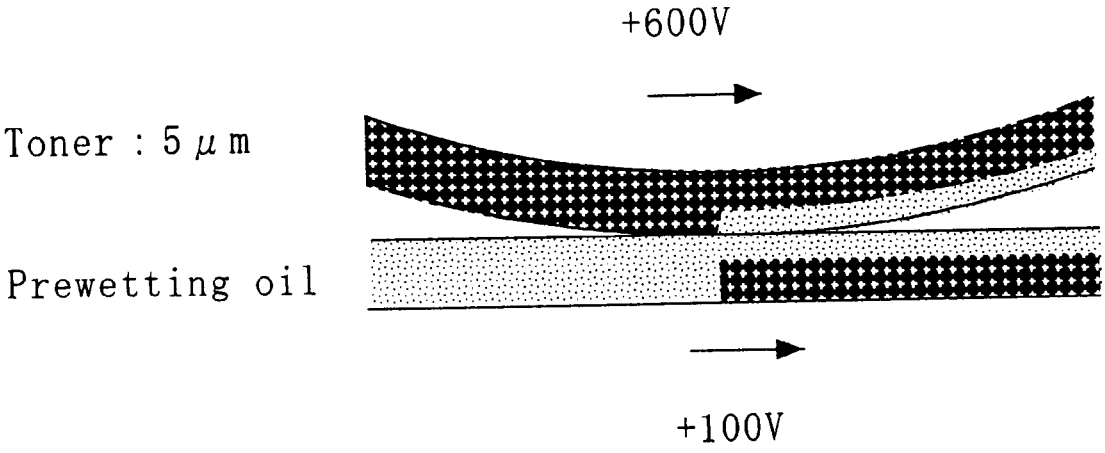
FIG. 20 is a diagram of assistance in explaining the high-speed migration of toner particles in a high-viscosity solution.

In order to cause toner particles to migrate at high speed in a solution having a high viscosity, development should be performed under a higher field intensity and over a shorter migration distance. To achieve this, an attempt was made to form a narrower gap (make the thickness of the prewetting layer thinner). As shown in FIG. 20, a 5 μm thickness of a developer having a toner solids concentration of 20 wt. % was evenly applied to a developing roller, and 4.5 μm and 10 μm of silicone oils having different viscosity values of 2.5 cSt and 20 cSt as the prewetting agents were applied to the photoconductive medium. The results of development by causing the developing roller to make contact with the photoconductive medium under this state were shown in Table 6.

TABLE 6

| Prewetting conditions | | Image density | Image noise (fog) | Image quality |
|---|---|---|---|---|
| SH344 (2.5 cSt) | 4.5 μm | 0.8 OD | X | Spots in image area |
| | 10 μm | 0.6 OD | ○ | |
| SH200 (20 cSt) | 4.5 μm | 1.2 OD | ○ | Improved uniformity in image area |
| | 10 μm | 1.0 OD | ○ | |

As is evident from the table, a higher development density was obtained with the use of a prewetting oil having a higher viscosity of 20 cSt during development where thinner toner and prewetting layers were provided and a strong field was applied across a narrower gap. This is attributable to the fact that migration of toner particles was carried out without relying on the principle of electrophoresis under developing conditions where a high-concentration, high-viscosity toner was used, and a strong field having a steep gradient was formed in a gap as narrow as 10 μm. It is conceivable that an electric double layer consisting of charged particles and surrounding reverse-polarity ions is polarized by the strong field, and the electrophoresis of individual particles is inhibited due to high toner density and oil viscosity, with the result that an operation mode close to the polarized transfer becomes predominant, with the toner layer relatively retaining its layer state. When testing conditions were changed to a state close to the test shown in FIG. 19 by increasing the developing gap and setting viscosity to a lower value, on the other hand, it can be considered that the mode of electrophoresis where particles are dependent on the amount of charge and oil viscosity becomes predominant.

Embodiment 4

When development was carried out by changing the viscosity of the carrier solution in the liquid toner to 100 cSt, an image density above 1.2 was obtained. When the content of dispersing agent was changed, however, a sharp reduction in image density was observed as the viscosity of the liquid toner was increased to more than 600 mPa·S. When the viscosity of the liquid toner fell below 100 mPs·s, fogging took place. This is attributable to the fact that when the toner layer and the prewetting layer at the developing nip portion are placed in a developing field, a toner having too high a viscosity could not be attracted to the image area by the static force caused by a field, while a toner having too low a viscosity could not overcome the resistance of the prewetting solution flowing into the nip portion, or the resistance of the prewetting solution when the liquid toner layer is separated at the exit of the nip portion due to the lack of the hardness of the toner. This could lead to disruptions in the toner layer, or adhesion of the toner to the non-image areas. Good image results were obtained when the viscosity of the toner is within the range of 100~500 mPa·s.

Industrial Applicability

As described above, the present invention makes it possible to remove excess prewetting solution and excess carrier solution in the developing toner layer before or after they are transferred from the photoconductive medium to the intermediate transfer medium, and control the replenishment of toner to the developing device in a wet-type electrophotography apparatus using non-volatile, high-viscosity, high-concentration liquid toner.

What is claimed is:

1. A wet-type electrophotography apparatus using a non-volatile, high-viscosity, high-concentration liquid toner as a liquid developer and comprising:

an image carrier on which an electrostatic latent image is formed;

prewetting solution applying means for applying a film of prewetting solution on the surface of the image carrier;

a developing roller feeding the liquid developer while making contact with the image carrier, and causing toner particles in the liquid developer to adhere to the image carrier in accordance with an electric field formed between the developing roller and the image carrier so that a toner image formed on the image carrier is transferred to a printing medium via an intermediate transfer medium; and oil removal means making contact with the toner image surface for removing from the formed toner image surface oil on the intermediate transfer medium having excess prewetting solution and excess carrier solution of the liquid toner in the toner layer.

2. A wet-type electrophotography apparatus as set forth in claim 1, wherein the prewetting solution is the same liquid as the carrier solution of the liquid toner, and the carrier solution is silicone oil.

3. A wet-type electrophotography apparatus as set forth in claim 2, wherein the viscosity of the silicone oil is 10~500 mPa·s.

4. A wet-type electrophotography apparatus as set forth in claim 2, wherein the liquid toner is such that the viscosity thereof is adjusted to the range of 100·500 mPa·s.

5. A wet-type electrophotography apparatus as set forth in claim 1, wherein the oil removal means comprises an oil removal roller making contact with the toner image surface on the intermediate transfer medium and rotating at the same speed as the contact surface on the intermediate transfer medium, and means making contact with the roller for removing oil adhering to the roller surface.

6. A wet-type electrophotography apparatus as set forth in claim 5, wherein the oil removal roller makes contact with the toner image surface on the intermediate transfer medium to remove the excess oil on the intermediate transfer medium.

7. A wet-type electrophotography apparatus as set forth in claim 6, wherein the oil removal roller removes the excess oil after the toner has been heated and fused.

8. A wet-type electrophotography apparatus as set forth in claim 5, wherein the oil removal roller is elastic.

9. A wet-type electrophotography apparatus as set forth in claim 5, wherein the oil removal roller is covered with an electrically conductive PFA tube.

10. A wet-type electrophotography apparatus as set forth in claim 1, wherein the intermediate transfer medium comprises an intermediate transfer belt, the intermediate transfer belt comprising an oil removal roller, and heating means for heating and fusing the toner image on the intermediate transfer belt at a location after the intermediate transfer belt makes contact with the image carrier and before the toner image is fused and transferred to a printing medium, and cooling means for cooling the toner image at a location after the toner image is fused and transferred and before the intermediate transfer belt makes contact with the image carrier.

11. A wet-type electrophotography apparatus as set forth in claim 1, wherein the oil removal means comprises an oil removal belt that makes contact with the toner image surface on the intermediate transfer medium and rotates at the same speed as the contact surface on the intermediate transfer medium, and means that makes contact with the oil removal belt for removing the oil adhering to the belt surface.

12. A wet-type electrophotography apparatus as set forth in claim 1, wherein the oil removal means comprises an oil removal roller or belt that makes contact with the toner image surface on the image carrier or the intermediate transfer medium and rotates at the same speed as the contact surface on the image carrier or the intermediate transfer medium, and a blade that makes contact with the oil removal roller or belt in a direction opposite to the rotation of the roller or belt.

13. A wet-type electrophotography apparatus as set forth in claim 12, wherein the blade is a rubber blade or an edge-rounded spring-steel blade.

14. A wet-type electrophotography apparatus as set forth in claim 1, wherein the oil removal means comprises an oil removal roller or belt, with a bias applied to the roller or belt.

15. A wet-type electrophotography apparatus as set forth in claim 14, wherein the oil removal roller or belt has a resistance of over $10^8$ Ω and a current value of under 10 $\mu$A.

16. A wet-type electrophotography apparatus using as a liquid developer a non-volatile, high-viscosity, high-concentration liquid toner obtained by dispersing a predetermined concentration of toner particles in a liquid carrier said apparatus comprising:

an image carrier on which an electrostatic latent image is formed;

prewetting solution applying means for applying a film of prewetting solution on the surface of the image carrier;

a developing roller for feeding the liquid developer while making contact with the image carrier, and causing toner particles in the liquid developer to adhere to the image carrier in accordance with an electric field formed between the developing roller-and the image carrier;

recovery means for recovering the liquid developer remaining on the surface of the developing roller as a liquid toner of a diluted concentration;

means for regenerating the liquid toner having a predetermined concentration as the liquid developer by mixing the recovered liquid toner of diluted concentration with a high-concentration liquid toner in which toner particles are dispersed at a concentration higher than the predetermined concentration at a predetermined ratio; and means for using the regenerated liquid toner as the liquid developer, wherein the means for regenerating the liquid toner comprises means for calculating printing duty on the basis of printing data, and means for determining the replenishments of the carrier and the toner particles by calculating the consumption of the liquid toner on the basis of the developing efficiency and the printing duty supplied by the calculating means.

17. A wet-type electrophotography apparatus as set forth in claim 16, wherein the high-concentration liquid toner mixed with the recovered diluted toner comprises toner particles and carrier solution supplied separately.

18. A wet-type electrophotography apparatus using a non-volatile, high-viscosity, high-concentration liquid toner as a liquid developer and comprising:

an image carrier on which an electrostatic latent image is formed, prewetting solution applying means for applying a film of prewetting solution on the surface of the image carrier;

a developing roller feeding the liquid developer while making contact with the image carrier, and causing toner particles in the liquid developer to adhere to the image carrier in accordance with an electric field formed between the developing roller and the image carrier so that a toner image formed on the image carrier is transferred directly to a printing medium, or to a printing medium via an intermediate transfer medium; and an oil removal roller making contact with the toner image surface on the image carrier and removing oil having excess prewetting solution and excess carrier solution of the liquid toner in the toner layer by causing to adhere to the roller surface, and means making contact with the roller for removing the oil adhered to the roller surface.

* * * * *